United States Patent [19]

Gunter

[11] 4,003,104

[45] Jan. 18, 1977

[54] COILER CALENDER ROLLS

[76] Inventor: Wilburn J. Gunter, 315 Virginia Ave., Greenwood, S.C. 29646

[22] Filed: Apr. 23, 1975

[21] Appl. No.: 570,620

[52] U.S. Cl. ..... 19/150; 19/159 R

[51] Int. Cl.[2] ..... D01G 25/00

[58] Field of Search ..... 19/157, 159 R, 272, 19/106, 150, 159 A; 242/82

[56] References Cited

UNITED STATES PATENTS

| | | | |
|---|---|---|---|
| 432,132 | 7/1890 | Francis | 19/159 R |
| 1,672,902 | 6/1928 | Penney | 19/159 R |
| 2,685,711 | 8/1954 | Hinton | 19/157 |
| 2,686,940 | 8/1954 | Burnham | 19/272 |
| 2,990,586 | 7/1961 | Norton et al. | 19/159 R |
| 3,035,311 | 5/1962 | Woodbury | 19/159 R |
| 3,241,196 | 3/1966 | Fornes et al. | 19/159 R |
| 3,304,582 | 2/1967 | O'Neal et al. | 19/106 R |
| 3,470,587 | 10/1969 | Kincaid | 19/159 R |
| 3,681,815 | 8/1972 | Gunter et al. | 19/159 R |

FOREIGN PATENTS OR APPLICATIONS

| | | | |
|---|---|---|---|
| 916,976 | 1/1963 | United Kingdom | 19/159 R |

*Primary Examiner*—Dorsey Newton
*Attorney, Agent, or Firm*—Bailey, Dority & Flint

[57] ABSTRACT

A calender roller apparatus is provided for use with sliver coilers and the like wherein a sliver is passed for delivery between surface engaging coiler rollers rotatably carried on a pair of parallel roller assemblies. One of the roller assemblies is fixed to a base platform and the other roller assembly is pivotably carried by the base platform at a point which is above the center line of the pivoted roller assembly providing a downward biasing force to the pivoted roller against the surface of the fixed roller, so that the sliver will be suitably compressed therebetween eliminating the need for a positive lock-down means which is normally found on pivotable calender rollers.

6 Claims, 4 Drawing Figures

COILER CALENDER ROLLS

BACKGROUND OF THE INVENTION

It has been common to use a calender roller apparatus on sliver coiling devices having a pair of adjacent rotatable rollers between which a sliver is tensioned for delivery. It is necessary to have some means of biasing the rolls toward each other to determine the extent to which the sliver is compressed during its passage between the rolls so as to control the weight and length of the sliver which is deposited in the coiler can.

Heretofore resilient biasing devices have been used to bias the rollers towards each other, such as the spring clip used in U.S. Pat. No. 2,876,502. However, the problem with such a device is that if the sliver breaks and the loose end is lapped around the roller surface the sliver buildup may cause the rollers to spread apart with operational breakage to the roller assembly. Another problem which can arise is that the sliver will sometimes pile up in the flow tube beneath the rollers causing the sliver to choke beneath the surface of the rollers which can also cause operational breakage of the rollers if the biasing means does not release, or the pivoted roller is otherwise prevented from flipping up.

Other prior devices have been developed for releasing the pivoted roller when the thickness of the sliver between the rollers exceeds a predetermined depth. Such a device is shown in U.S. Pat. No. 3,443,282 wherein a latching lever is provided to latch the rollers apart in a spread position when the thickness of the sliver between the rollers exceeds a predetermined depth. However, when the rollers are run on high speed coiling machinery the pivoted roller tends to flip up in the absence of a more positive lock-down means due to the tension between the trumpet which feeds the sliver in the rollers.

Another prior device which attempts to use a more positive lock-down means for biasing the rollers together is shown in U.S. Pat. No. 3,391,427 wherein a pivoted latch is attached at one end to the pivotable roller member, and the other end of the latch slides over and abuts a spring bias plunging member for biasing the two rollers towards each other. The latching member is designed to release and hence allow the rollers to separate when excessive sliver buildup occurs between the rollers and at the same time to hold the rollers together in a positive manner. However, should the sliver strand become broken and a broken end thereof adhere to one of the rollers the sliver buildup can spread the rollers to such an extent as to possibly twist the pivoted roller about its pivot support before the latching member is released causing breakage at the pivot point. If the sliver chokes in the tube beneath the rollers the pile up of sliver beneath the surface of the two rollers could also possibly exert a sufficient upward force on the roller assembly to cause possible breakage before the latching member is released.

Accordingly, an important object of the present invention is to provide a coiler calender roller apparatus which will uniformly compress a sliver being passed for delivery between the rollers.

Another important object of the present invention is to provide a calender roller apparatus which can be run on a high speed sliver coiler without the need of a positive lockdown latch.

Another important object of the present invention is to provide a coiler calender roller apparatus wherein a pivoted roller is automatically released when slivers build up either beneath or around the rollers, thus preventing breakage of the roller assembly.

Another important object of the present invention is to provide a coiler calender roller apparatus wherein one of the rollers is pivoted and wherein the pivoted roller may be adjusted on its support to provide an adjustable biasing force between the rollers.

Another important object of the present invention is to provide a simplified coiler calender roller apparatus which is easy and simple to operate and which provides easy and quick access to any sliver buildup by the machine operator.

SUMMARY OF THE INVENTION

It has been found that a simplified, improved calendar roller apparatus may be provided for handling textile slivers in sliver coilers wherein the calender roller apparatus comprises a base member for mounting on a sliver coiling machine which carries a pivot support, and a pair of roller assemblies having coiler rollers between which the sliver is passed for delivery. One of the roller assemblies if fixed to the base member and the other roller assembly is pivotably carried by the base member on the pivot support. The pivot support includes a fulcrum located above a horizontal plane passing through the center of the pivoted roller assembly or on the sliver feed side of the rollers.

By so locating the fulcrum of the pivoted roller, the pivoted roller is biased against the fixed roller and is prevented from popping up due to high speed operation by a downward force exerted from the above pivot point. If an excessive amount of sliver pileup occurs due to choking or lapping then the pivoted roller automatically is released and pops up relieving pressure on the rollers and preventing breakage of the roller assembly.

It has also been found that a magnetized roller can be utilized to eliminate the need for a positive lock-down latch or other device.

BRIEF DESCRIPTION OF THE DRAWING

The construction designed to carry out the invention will hereinafter be described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
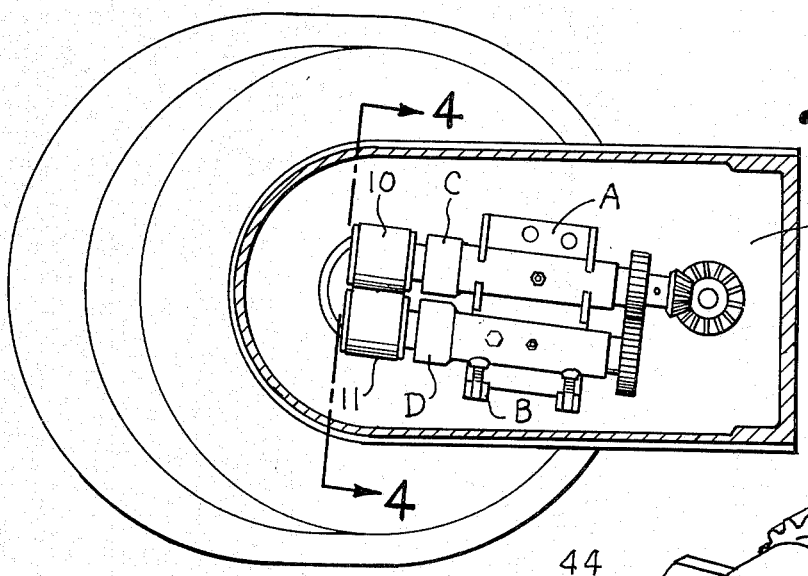
FIG. 1 is a top plan view illustrating a coiler calender roller apparatus constructed in accordance with the present invention mounted on the head of a sliver coiling machine.

The drawing illustrates a calender roller apparatus for handling textile slivers in sliver coilers. The calender roller apparatus comprises a base member A which carries a pivot support, B, and a pair of roller assemblies C and D having surface engaging, parallel aligned coiler rollers 10 and 11 rotatably carried thereon between which the sliver is passed for delivery. The roller assembly C is fixed with respect to the base member, and roller assembly D is pivotably carried by the pivot support. The pivot support includes a fulcrum 12 located above a horizontal plane passing through the center of the rollers, or on the sliver feed sides of the rolls, when in a position of roller engagement so as to provide a force opposing the tendency of the pivoted roller to flip up. Thus, by so locating the fulcrum of the pivoted roller, the pivoted roller is prevented from flipping up during high speed operation while automatically being released or flipped up due to sliver buildup caused by a broken sliver lapping around the roller or by the chokeup of sliver below the rollers in the flow tube.

The coiler calender roller apparatus, constructed in accordance with the present invention, is made from steel instead of cast iron which is conventionally used. The steel parts provide precision and strength to the structure, and may be more readily replaced.

The base member may be attached to the head of the coiling machine E using any conventional fastening means such as bolts. Roller assembly C is mounted to the base member in a fixed manner, as for example, by welding. The pivot support includes a pair of laterally spaced support members 13 and 14 carried by the base member extending vertically well above the center line of the rollers having an opening 15 and 16, respectively, formed adjacent an upper end for providing a fulcrum opening therein. The support members may be made integral with the base member as by welding and the like.

A means for pivotably carrying the pivoted roller assembly includes a pair of laterally spaced socket members 17 and 18 carried by the pivoted roller assembly having internal threads therein, and a pair of bolt members 19 and 20 having threaded ends for adjustable insertion into the socket members. A hole extends through the other end of each of the bolt members for receiving a fastening means therethrough such as dial pins 21 and 22 which also pass through the fulcrum openings 15 and 16 to pivotably attach each of the bolt members to each of the support members. The bolt members may be removed from the support members by removing the dial pins, and then the bolt members may be turned inwardly or outwardly in the socket members to adjust the distance between the pivoted roller assembly and the support members. In this manner, the bias force of the pivoted roller against the fixed roller may be adjusted so as to adjust the amount of compression applied to the sliver being passed for delivery between the rollers maintaining the proper amount of compression on the sliver held between the rollers.

Figure 4:
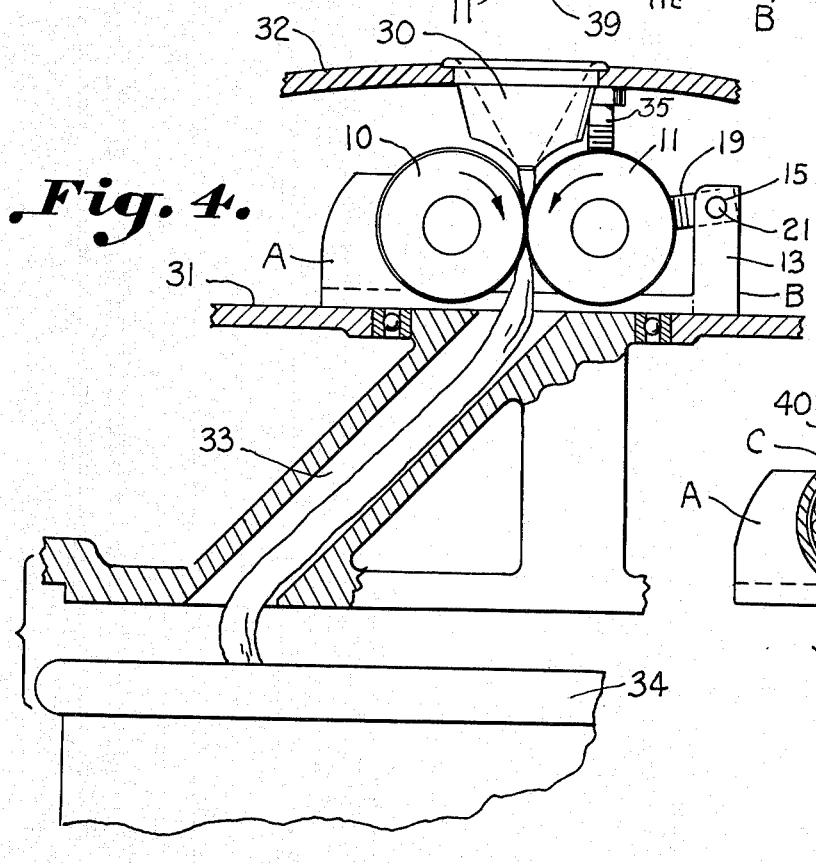
FIG. 4 is a sectional view taken along line 4—4 of FIG. 1.

Referring to FIG. 4, the calender roller apparatus is illustrated mounted to a conventional tube gear cover 31 of a coiling machine. A cover 32 covers the head of the coiling machine and carries the trumpet 30 through which the sliver flows as it is passed for delivery between the rollers 10 and 11, through the flow tube 33 into the coiling can 34. An adjustable screw 35 is carried by the pivoted roller assembly for supporting the coiling machine cover. The weight of the cover may be uitlized to provide an additional force which biases the coiler rollers together when the screw is adjusted just slightly out of contact with the cover or the screw may be adjusted downwardly so as to omit the affect of such. In any case, the affect of the cover will not prevent the pivoted roller from flipping up should sliver lap around or choke up beneath the rollers. The coiler rollers 10 and 11 are rotated, counter-clockwise by the sleeved pinion gears 36 and 37, respectively, to freely pass the sliver into a coiling can in a conventional manner as disclosed, for example, in U.S. Pat. No. 3,443,282.

Figure 3:
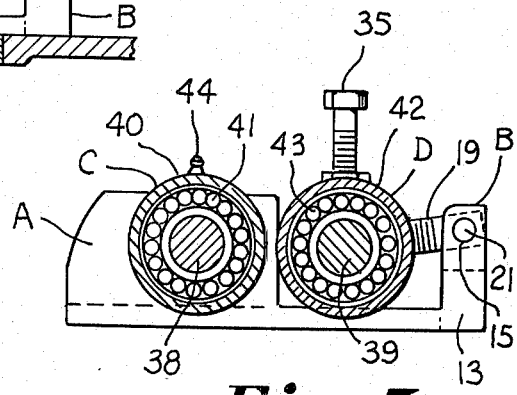
FIG. 3 is a sectional view taken along line 3—3 of FIG. 2.

The coiler rollers are fitted on the shaft 38 and 39 in a conventional manner as are the pinion gears 36 and 37. Roller assembly C includes a bearing 40 which houses a plurality of needle bearings 41 in which the shaft 38 rotates as is best seen in FIG. 3. Roller assembly D includes similar bearing 42 and needle bearings 43 in which the shaft 39 rotates. Each roller assembly is provided with a lubrication fitting 44 so that the bearings may be lubricated. The roller 10 is provided with beveled edges at **10*a* and 10*b* and the roller 11 is similarly provided with beveled edges at 11*a* and 11*b* so that the pressure of the two rollers against each other will be concentrated towards the center of the strips 10*c* and 11*c***. The beveled edges aid in maintaining the parallel relationship between the rollers. Without beveled edges, the rollers might tend to bear against each other at the ends thereof preventing uniform pressure from being applied at the center of the rollers.

In use, when the rollers 10 and 11 are driven at high speed in an operational position for passing sliver therebetween, a force will be exerted by the pivoted roller 11 against the surface of the fixed roller 10 which will have a downward component tending to prevent the roller 11 from flipping up. This is so because the fulcrum 12 is above the center of the rollers 10 and 11 and therefore a force exerted from the fulcrum to the point of contact between the rollers will have a normal component and a downward tengential component. This downward tangential component of force will tend to prevent the roller 11 from flipping up. In the prior devices where the pivot point or fulcrum was located below the center of the roller the force exerted by the pivot point contributed an upward tangential component which tended to flip the roller upwardly at high speeds. However, the downward force exerted by the raised fulcrum will not be of sufficient magnitude to prevent the pivoted roller from automatically flipping up if sliver builds up sufficiently underneath the surface of the rollers. In this instance, the pivoted roller will be allowed to flip up thus preventing breakage of the calender roller assembly. Likewise, if the sliver should break and wrap around the surface of either roller the rollers will begin to spread apart and such buildup will also automatically overcome the downward force from the raised fulcrum and allow the pivoted roller to flip up. The biasing force from the raised fulcrum allows some leeway for sliver of different thicknesses to pass between the rollers 10 and 11 to providing uniform compression before being overcome sufficiently to allow releasing of the pivoted roller.

Figure 2:
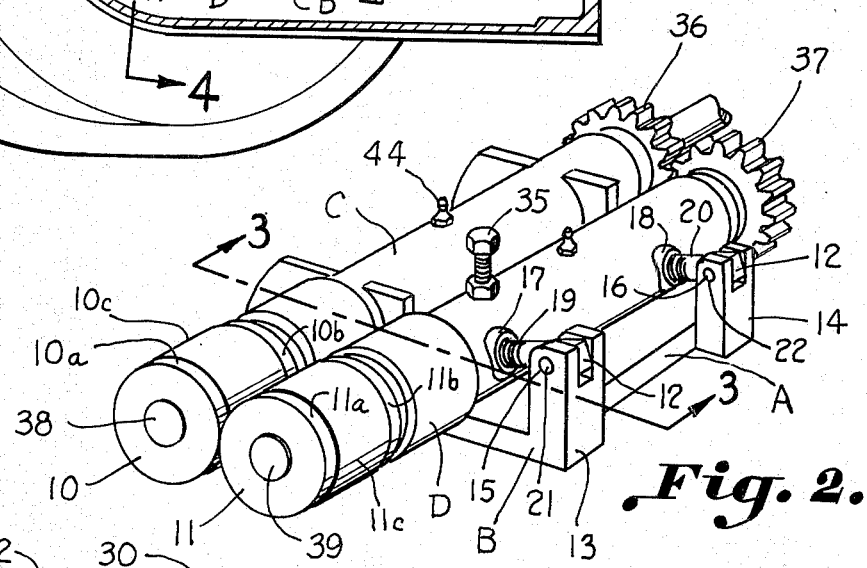
FIG. 2 is a perspective view illustrating a coiler calender roller apparatus constructed in accordance with the present invention.

The provision of a pair of pivot supports spaced a substantial distance apart, as shown in FIGS. 1 and 2, adds strength to the calender roller assembly, as compared to a single pivot support, particularly in the case where a lap up around one of the rollers spreads the rollers apart. For purposes of illustration only and not for limitation thereto, in one particular embodiment, the pivot supports were spaced approximately 3 inches apart and approximately 3 inches from either end of the pivoted roller assembly, and the fulcrum was spaced approximately ¼ of an inch above the center line of the pivoted roller. The pivot supports are usually made integral with the base member as by welding and the like. By so spacing the support members, the support members are located closer to the ends of the roller assembly thereby reducing the moment arm between the spreading roller and its support as the roller attempts to twist about its support. The moment of the spreading pivoted roller about its support is reduced to such a magnitude that the roller will flip up before the moment of force due to spreading is sufficient to cause breakage at the pivot supports.

It has also been found that one of the coiler rollers can be magnetized, preferably the coiler roller 11 of the pivotable roller assembly D, to eliminate the need for a positive lock-down member. Magnetized rolls have been used such as in drafting rolls of a spinning frame and as in web crush rolls of a carding machine to provide a uniform crushing action along the length of the rolls. However, in these systems, the rolls move in a straight line relative to each other whereas in a calendar coiler roll assembly one roll is fixed and the other roll is pivoted relative thereto. In the former case the magnetic roller is not uitlized to exert a hold-down force as it is the present or latter case.

When uitlizing a magnetic roll in accordance with the present invention, the coiler roller 11 may be magnetized entirely or a magnetic band may be formed, as by machining and the like, in the beveled edge 11a using the same or a different type of material. With the roller magnetized, a force of attraction exists between the rollers 10 and 11 when in the operational position to properly tension the sliver therebetween. Should a lap up occur around a roller causing the rollers to spread the magnetic force would be overcome allowing release of the pivoted roller assembly D. Likewise, the roller assembly D would release should excessive choke occur beneath the rollers. Thus, the need for a positive lock-down mechanism is eliminated reducing the possibility of operational breakage of the calendar coiler roller apparatus while proper tensioning of the sliver between the rollers is maintained.

Also when utilizing a magnetic roller, it is not necessary to raise the fulcrum point of the pivotable roller assembly to the extent necessary without the magnetized roller. In fact, it has been found that in some conventional calendar roller assemblies which utilize a roller pivoted adjacent the base, that replacement with a magnetized roller eliminates the need for the positive lock-down mechanism with proper tensioning of sliver and hold down between the rollers being provided solely by the magnetic force therebetween.

Thus, it can be seen that a simple compact calender roller apparatus is provided wherein a positive lock-down means, such as a latch, for biasing the rollers together is eliminated while at the same time the pivoted roller is prevented from flipping up during high speed operation and protection is afforded against breakage of the assembly should lap-up around the rollers or choke-up beneath the rollers of the sliver occur. The calender roller apparatus constructed in accordance with the present invention also affords quick and simple adjustment of the spacing between the rollers and the gears of each roller member by removing the dial pins from the pivot support and turning the threaded bolt members in or out of the sockets carried on the pivoted roller assembly. An attendant operating the sliver coiling machine can easily remove sliver buildup or lap which occurs causing the pivoted roller to flip up, and can reposition the pivoted roller in operating position without requiring further assistance.

While a preferred embodiment of the invention has been described using specific terms, such description is for illustrative purposes only, and it is to be understood that changes and variations may be made without departing from the spirit or scope of the following claims.

What is claimed is:

1. A calender roller apparatus for handling textile slivers in sliver coilers comprising:

a. a base member carrying a pivot support;

b. a pair of roller assemblies having surface engaging coiler rollers rotatably carried thereon with parallel center lines between which said sliver is passed for delivery;

c. one of said roller assemblies being fixedly mounted to said base member;

d. means for pivotably carrying the other of said roller assemblies on said pivot support;

e. said pivot support including a fulcrum located above a horizontal plane passing through the center of said pivotably carried roller assembly when in an operational position for sliver delivery providing a biasing force opposing the tendency of the pivoted roller assembly to flip up and for properly compressing the sliver held between the coiler rollers;

f. said biasing force effectively maintaining said pivoted roller assembly in said operational position at high speed operation while permitting said pivoted roller assembly to release should excessive sliver buildup occur beneath or around said coiler rollers; and g. said pivot support including at least one support member extending vertically above the center line of said pivoted roller assembly with said fulcrum located adjacent an upper end thereof, and said means for carrying said pivoted roller assembly including an adjustable linkage means connected between said support and said pivoted roller assembly to adjust the distance therebetween.

2. The apparatus of claim 1 wherein each of said coiler rollers includes a smooth cylindrical roller having beveled edges.

3. The structure of claim 1 wherein said adjustable linkage means includes:

a. a pair of laterally spaced socket members carried by said pivoted roller assembly having internal threads;

b. a pair of bolt members having a threaded end portion for adjustable insertion into said socket members;

c. connecting means carried by the other end of each of said bolt members; and d. fastening means for removably attaching said connecting means to said fulcrum;

whereby said bolt members may be removed from said support member and turned inwardly or outwardly in said socket members to adjust the distance between said other roller assembly and said support.

4. The apparatus of claim 1 wherein said pivoted roller assembly carries an adjustable screw member for contacting a cover of the sliver coiler whereby the weight of the cover on the screw member provides an additional force opposing the tendency of the pivoted roller to flip up.

5. The apparatus of claim 1 wherein one of said coiler rollers is magnetized providing a force biasing said coiler rollers towards each other.

6. The structure of claim 1 wherein said pivot support includes two of said support members laterally spaced and wherein said adjustable linkage means includes a pair of spaced attachment means carried on said pivoted roller assembly in alignment with said spaced support members and a linkage member adjustably connected at one end to said attachment means and pivotably connected to said fulcrum adjacent the opposite end thereof.

* * * * *